US007132995B2

(12) United States Patent
Gottl

(10) Patent No.: US 7,132,995 B2
(45) Date of Patent: Nov. 7, 2006

(54) ANTENNA HAVING AT LEAST ONE DIPOLE OR AN ANTENNA ELEMENT ARRANGEMENT SIMILAR TO A DIPOLE

(75) Inventor: Maximilian Gottl, Frasdorf (DE)

(73) Assignee: Kathrein-Werke KG, Rosenheim (DE)

( * ) Notice: Subject to any disclaimer, the term of this patent is extended or adjusted under 35 U.S.C. 154(b) by 6 days.

(21) Appl. No.: 10/738,208

(22) Filed: Dec. 18, 2003

(65) Prior Publication Data

US 2005/0134517 A1 Jun. 23, 2005

(51) Int. Cl.
*H01Q 21/26* (2006.01)

(52) U.S. Cl. ..... 343/797

(58) Field of Classification Search ..... 343/797, 343/793, 798, 810, 812–820, 790–792
See application file for complete search history.

(56) References Cited

U.S. PATENT DOCUMENTS

| | | | | |
|---|---|---|---|---|
| 2,501,020 | A | 3/1950 | Barnes | 343/872 |
| 2,511,849 | A | 6/1950 | Hilferty et al. | 343/773 |
| 3,419,872 | A | 12/1968 | St. Vrain | 343/792 |
| 3,740,754 | A | 6/1973 | Epis | 343/797 |
| 4,074,268 | A | 2/1978 | Olson | 343/399 |
| 4,115,783 | A * | 9/1978 | Reggia | 343/792 |
| 4,218,685 | A | 8/1980 | Ellis | 343/727 |
| 4,254,422 | A | 3/1981 | Kloepfer et al. | 343/792 |
| 4,814,777 | A | 3/1989 | Monser | 343/727 |
| 4,890,116 | A | 12/1989 | Lewis, Jr. | 343/749 |
| 4,972,196 | A | 11/1990 | Mayes et al. | 343/700 MS |
| 5,451,968 | A | 9/1995 | Emery | 343/749 |
| 5,710,569 | A | 1/1998 | Oh et al. | 343/817 |
| 5,966,102 | A * | 10/1999 | Runyon | 343/797 |
| 6,028,563 | A * | 2/2000 | Higgins | 343/816 |
| 6,034,649 | A | 3/2000 | Wilson et al. | 343/795 |
| 6,127,979 | A | 10/2000 | Zhou et al. | 343/702 |
| 6,404,396 | B1 | 6/2002 | Hung et al. | 343/749 |
| 6,933,906 | B1 * | 8/2005 | Stolle et al. | 343/797 |
| 2003/0103008 | A1 | 6/2003 | Petropoulos et al. | 343/702 |
| 2002/0201537 | | 10/2004 | Stolle et al. | 343/797 |

FOREIGN PATENT DOCUMENTS

| | | |
|---|---|---|
| DE | 37 09 163 C2 | 10/1987 |
| DE | 3639106 A1 | 5/1988 |

(Continued)

OTHER PUBLICATIONS

Ch.Braun et al, "Elektrisch kurze Antennen zur Feldmessung", Fraunhofer-Institut für Naturwissenschaftlich-Technische Trendanalysen (INT) (Mar. 1996).

(Continued)

*Primary Examiner*—Tuyet Vo
*Assistant Examiner*—Ephrem Alemu
(74) *Attorney, Agent, or Firm*—Nixon & Vanderhye PC

(57) ABSTRACT

An improved antenna includes a coupling element in the form of a rod. The coupling element is electrically conductive and extends transversely with respect to the reflector plane is provided on the front face of the reflector. A mount device has an axial hole in the interior. The axial hole in the mount device can be placed on the coupling element which is in the form of a rod, such that the mount device and the coupling element which is the form of a rod are capacitively coupled, while avoiding any electrically conductive contact.

25 Claims, 8 Drawing Sheets

FOREIGN PATENT DOCUMENTS

| | | | |
|---|---|---|---|
| DE | 196 27 015 | A1 | 1/1998 |
| DE | 197 22 742 | A1 | 12/1998 |
| DE | 198 23 749 | A1 | 12/1999 |
| DE | 100 12 809 | A1 | 9/2001 |
| DE | 101 50 150 | A1 | 5/2003 |
| DE | 103 16 564 | A1 | 11/2004 |
| WO | WO 97/22159 | | 6/1997 |
| WO | WO 00/39894 | | 7/2000 |
| WO | WO 02/50940 | A2 | 6/2002 |
| WO | WO2004/091050 | A1 | 10/2004 |

OTHER PUBLICATIONS

Brochure, "Omnidirectional Indoor Antenna" (Kathrein Scala Division IDBO-890-1900), Jun. 13, 2003.
Brochure, "Directional Indoor Antenna" (Kathrein Scala Divsion IBP5-900/1940), Jun. 13, 2003.

* cited by examiner

ANTENNA HAVING AT LEAST ONE DIPOLE OR AN ANTENNA ELEMENT ARRANGEMENT SIMILAR TO A DIPOLE

FIELD

The technology herein relates to an antenna having at least one dipole or an antenna element arrangement which is similar to a dipole.

BACKGROUND AND SUMMARY

Dipole antenna elements have become known, for example, from prior publications DE 197 22 742 A and DE 196 27 015 A. The dipole antenna elements may in this case have a normal dipole structure or, for example, may be formed from a cruciform dipole arrangement or a dipole square, etc. A so-called vector cruciform dipole is known, for example, from the prior publication WO 00/39894. The structure appears to be comparable to a dipole square. However, in the end, the specific configuration of the dipole antenna element according to this prior publication creates a cruciform dipole structure from the electrical point of view, so that the antenna element formed in this way can transmit and receive in two mutually orthogonally aligned polarizations. All of these prior publications as well as the other dipole structures which have been known for a long time by the average person skilled in the art are to this extent also included in the content of the present application.

In the past, dipole antenna elements or antenna elements similar to dipoles have generally been positioned on the reflector such that they are electrically, that is to say conductively, connected to the reflector. However, it has already been proposed in commonly-assigned copending published U.S. patent application US2004-0201537A1 that was not published prior to this for an antenna element such as this to be capacitively coupled to the reflector plate. With the interposition of, for example, a non-conductive element, in particular a dielectric, or with the formation of a non-conductive contact section on the antenna element or on its mount device on which the antenna element is placed on the reflector plate, it is thus possible for the antenna element to be positioned on the reflector in a uniquely reproducible manner from the electrical point of view, since this avoids the intermodulation problems which occur in some circumstances according to the prior art. This is because, when a dipole or antenna elements which are similar to dipoles were mechanically mounted on the reflector plate according to the prior art, they were normally fitted to the reflector plate by means of screws or other connecting mechanisms, thus making it possible for different contact conditions to occur, depending on the installation accuracy, with the consequence that intermodulation problems could occur, which express themselves in different ways.

It is also desirable to take into account the fact that in the majority of all cases, the dipoles or antenna elements similar to dipoles are placed on the reflector plate and are mounted from the reflector rear face by screwing in one or more screws. However, if the contact pressure also decreases, for example because of heat influences, then the contact conditions change, thus resulting in a significant decrease in the performance of an antenna element such as this.

According to US2004-0201537A1, while avoiding an electrically conductive contact by using capacitive coupling, it is also possible to achieve the further advantage that no voltage potential can occur between the dipole and the reflector. This is because the differently chosen materials for a dipole antenna element or for the mount device for a dipole antenna element and the material for the reflector conventionally otherwise result in an electrochemical voltage which can lead to contact corrosion. Since the exemplary illustrative non-limiting implementation herein avoids this, this also results in a greater range of possible selections for the materials which can be used for the dipole and/or for the reflector.

The exemplary illustrative non-limiting implementation will be described in the following text with reference to a so-called vector dipole, whose fundamental configuration is known from WO 00/39894, whose entire disclosure content is referred to. However, the exemplary illustrative non-limiting implementation herein can be applied to all dipoles, for example also to cruciform dipoles or simple dipoles, such as those which are known from DE 197 22 742 A1, DE 198 23 749 A1, DE 101 50 150 A1 or, for example, U.S. Pat. No. 5,710,569.

The exemplary illustrative non-limiting implementation herein thus provides a further improved antenna with capacitive coupling between the antenna element or its mount device and an associated conductive reflector or a conductive reflector surface.

The present exemplary illustrative non-limiting implementation herein results in a significant improvement in comparison to conventional antennas that are known from the prior art. In this case, the present exemplary illustrative non-limiting implementation represents another more far-reaching improvement even in comparison to the solution which was mentioned above but was not published prior to this, according to which capacitive coupling of the antenna to the reflector was already provided.

The exemplary illustrative non-limiting implementation now provides an electrically conductive coupling element which projects in the form of a rod from the reflector and is preferably electrically conductively connected to the reflector plate. The actual antenna element device can be placed on this. Generally, the mount device to which the dipole antenna element or the antenna element structure in the form of a dipole is fitted, has an axial recess by means of which the mount device can be placed on the coupling element. The coupling element may be in the form of a rod. Although the coupling element which is in the form of a rod enters the axial recess in the mount device and generally comes to rest coaxially in the axial recess in the mount device, the coupling element which is in the form of a rod is electrically conductively isolated from the conductive mount device. This results inter alia in capacitive and/or possibly inductive outer conductor coupling between the reflector and the coupling element, which is preferably electrically conductively connected to the reflector, on the one hand, and the electrically conductive part of the mount device.

In one preferred exemplary illustrative non-limiting implementation, the electrically conductive coupling element which is in the form of a rod is in this case in the form of a tubular body, which can be soldered, welded or mounted in some other way on the reflector plate. A hollow-cylindrical sleeve which acts as an insulator or some other illustrated spacer is then just pushed onto the coupling element which is in the form of a rod, a flange preferably being formed at the lower end of this sleeve which acts as the dielectric, and the conductive mount device for the antenna element structure can be pushed on as far as this flange.

However, in a development of the exemplary illustrative non-limiting implementation, air may also be used as the dielectric. One can do this by using specific spacers to ensure that the electrically conductive mount device which is fitted does not make an electrically conductive contact with the reflector, and/or with the coupling element which is in the form of a rod and is electrically connected to the reflector.

In principle, it is also possible for the electrical mount device itself to be formed from non-conductive material, for example plastic. An electrically conductive covering may be drawn over it on the outside. The mount device can then be placed onto the electrically conductive coupling element, which is in the form of a rod, with a sliding face. Preferably, a small amount of play may be provided with the length of the coupling elements which are in the form of rods, also making it possible to ensure that the lower end of the mount device, adjacent to the reflector, cannot make contact with the reflector. Alternatively or in combination, an insulating layer may likewise be formed or provided here, or the end wall of the mount device is not provided with an electrical outer layer at this point.

As has been mentioned, the coupling element which is in the form of a rod is preferably hollow or is hollow-cylindrical. A corresponding recess is provided, axial in line with respect to it, in the reflector. This makes it possible to connect the outer conductor of a coaxial cable for feeding the antenna element arrangement to the reflector plate on its rear face, and/or to connect it to the tubular attachment, which may also project on the lower face, of the electrically conductive coupling element which is in the form of a rod (generally to be connected electrically conductively, for example by soldering), and to pass the inner conductor coaxially through the coupling element which is in the form of a rod upwards, such that it is electrically isolated from it in order to connect the inner conductor in some suitable manner there, that is to say in general to electrically connect it to the opposite dipole half.

In a development of the exemplary illustrative non-limiting implementation, an electrical element which is in the form of a rod and is integrated firmly there may be provided for the inner conductor in the coupling element which is in the form of a rod, so that the inner conductor is connected at the bottom. However, the inner conductor may also be laid upwards as an extended inner conductor in the form of a cable through the element which is in the form of a rod, preferably with the interposition of an isolator.

However, it is also possible to pass an inner conductor in its entirety through the element which is in the form of a rod and to connect the outer conductor located at the top to the element which is in the form of a rod and, separately from this, to design the inner conductor such that it is lengthened with respect to the dipole half that is generally opposite or to make electrical contact with an electrical connecting bracket in the immediate physical vicinity, in order to make electrical contact with the outer conductor, with this connecting bracket producing a connection for the opposite dipole half.

However, fundamentally, it is also possible to reverse the coupling principle. Specifically, the coupling element may be in the form of an outer pot part which is conductively connected to the reflector. The mount section of the dipole is positioned in the interior of this by means of an isolator, by means of air or in some other suitable manner, in order to achieve the coupling, which is primarily referred to as capacitive outer conductor coupling.

A wide range of further modifications, some of which will also be explained in detail in the description, are possible.

Finally, in one preferred exemplary illustrative non-limiting implementation, it is likewise possible to likewise design the inner conductor contact to be capacitive.

BRIEF DESCRIPTION OF THE DRAWINGS

These and other features and advantages will be better and more completely understood by referring to the following detailed description of exemplary non-limiting illustrative implementations in conjunction with the drawings of which.

DETAILED DESCRIPTION

Figure 1:
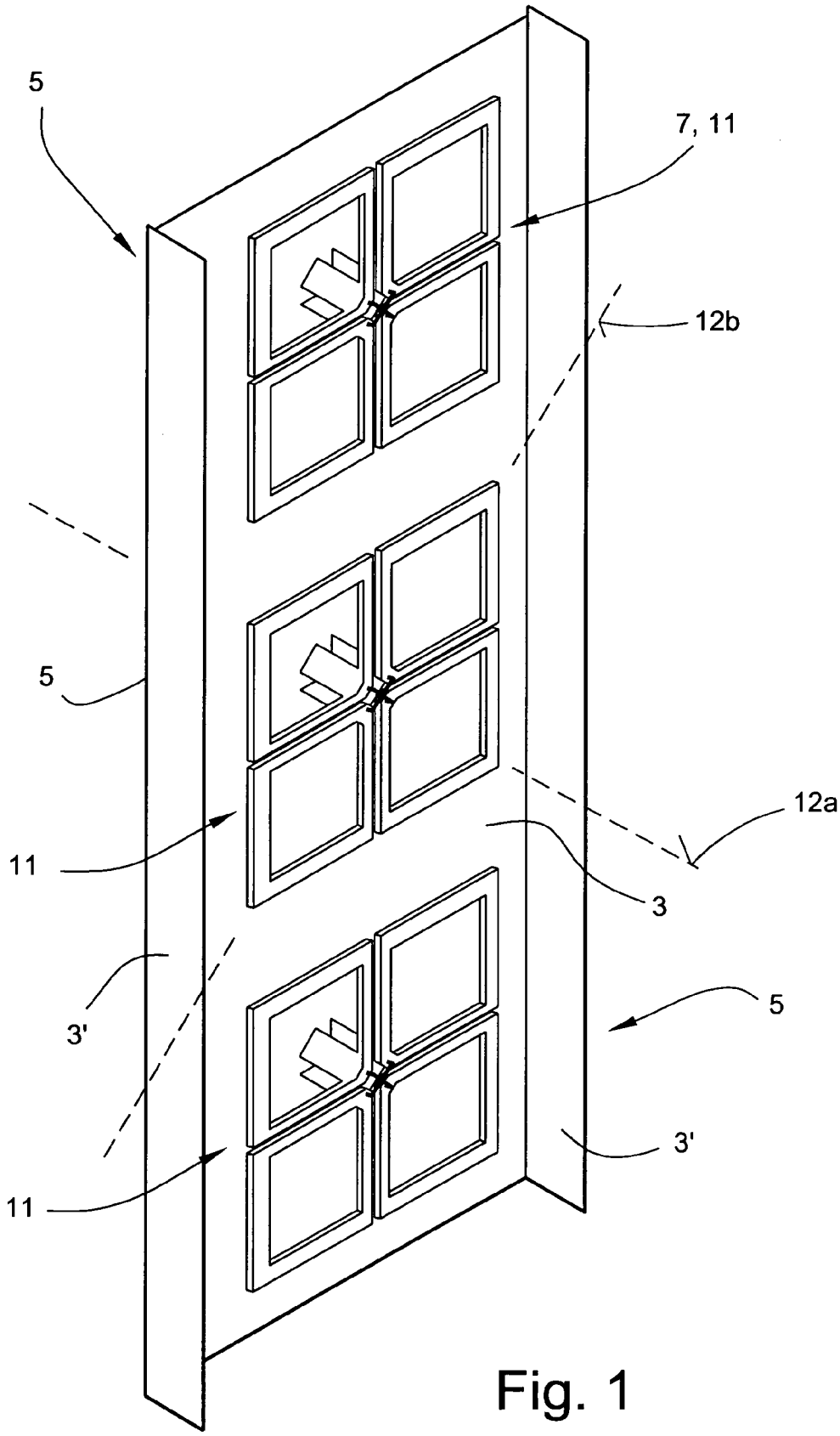
FIG. 1 shows a schematic perspective illustration of an exemplary illustrative non-limiting single-column antenna array with three dual-polarized antenna elements which are arranged vertically one above the other.

FIG. 1 shows a schematic illustration of an antenna arrangement 1 with a reflector or reflector plate 3. The reflector 3, for example in the form of a reflector plate, may preferably be provided on both of its opposite longitudinal faces 5, or offset further inwards from these longitudinal faces 5, with a reflector boundary 3' which, for example, may be aligned at right angles to the plane of the reflector plate 3, or else at an angle which runs obliquely and is not a right angle.

Two or more dipoles or antenna elements similar to dipoles are normally arranged offset with respect to one another in the vertical direction on a reflector plate 3 such as this. The antenna element or the antenna element arrangements 11 may be formed from single-band antenna elements, dual-band antenna elements, triple-band antenna elements or, in general, from multiband antenna elements or the like. Dual-band antenna elements or even triple-band antenna elements are preferably used for the present-day generation of antennas, and these can also transmit and/or receive in two polarizations which are aligned orthogonally with respect to one another and are preferably in this case aligned at an angle of ±45° to the horizontal or to the vertical. In this case, reference is made in particular to the prior publications DE 197 22 742 A and DE 196 27 015 A, which indicate and describe different antennas with widely differing antenna element arrangements. All of these antenna elements and modifications of them may be used for the purposes of the present exemplary illustrative non-limiting implementation. It is thus also possible to use antenna elements with a real dipole structure, in the form of a cruciform dipole, of a dipole square or in the form of its so-called vector dipole, that is known by way of example from WO 00/39894. All of these antenna element types and modifications are included in the content of this application, with reference to the prior publication cited above. The exemplary implementations with regard to FIGS. 2*a* and 2*b* concern radiating elements which could basically be used in the antenna system of the pending application whereby these radiating elements, however, are well-known by the prior published WO 00/398945.

Figure 2:
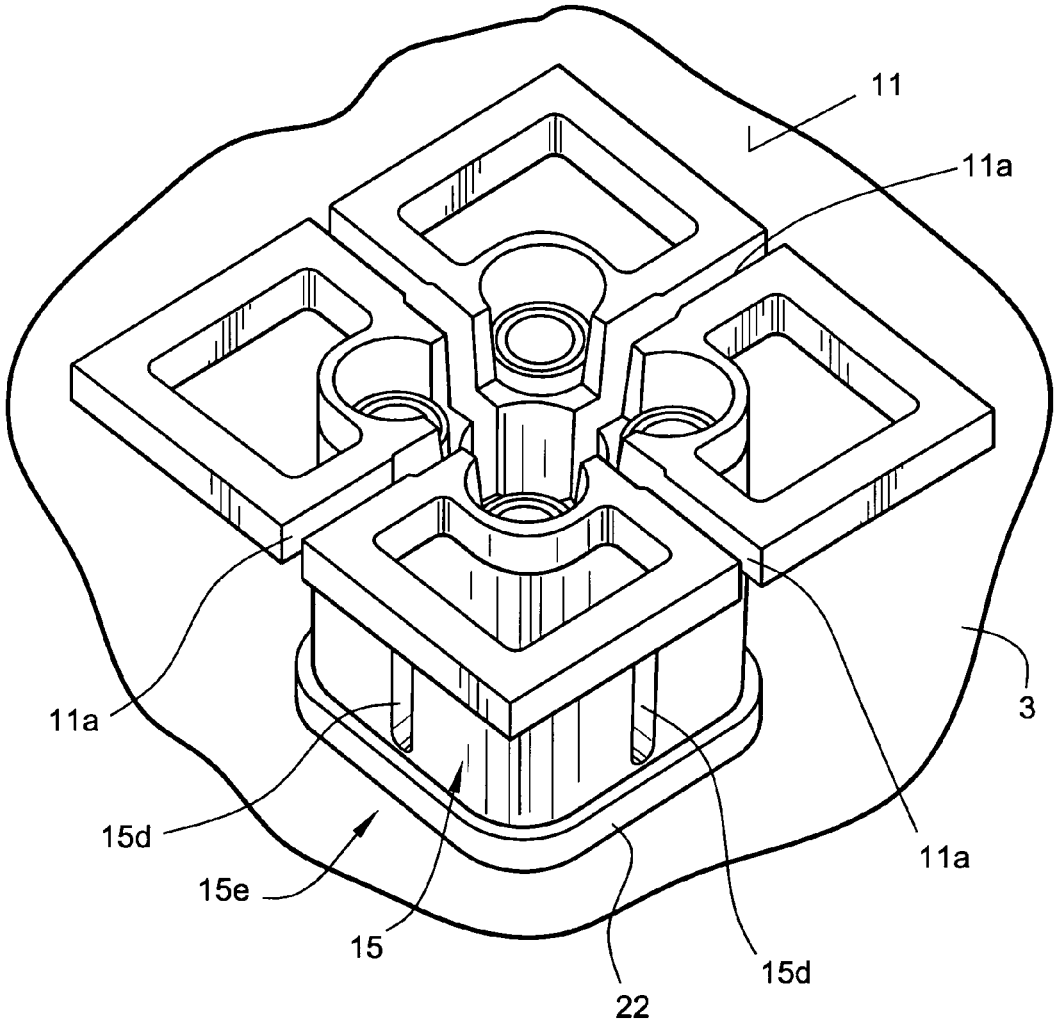
FIG. 2 shows a schematic perspective illustration of an exemplary illustrative non-limiting single antenna element, as is used in FIG. 1, in front of a reflector.
Figure 2A:
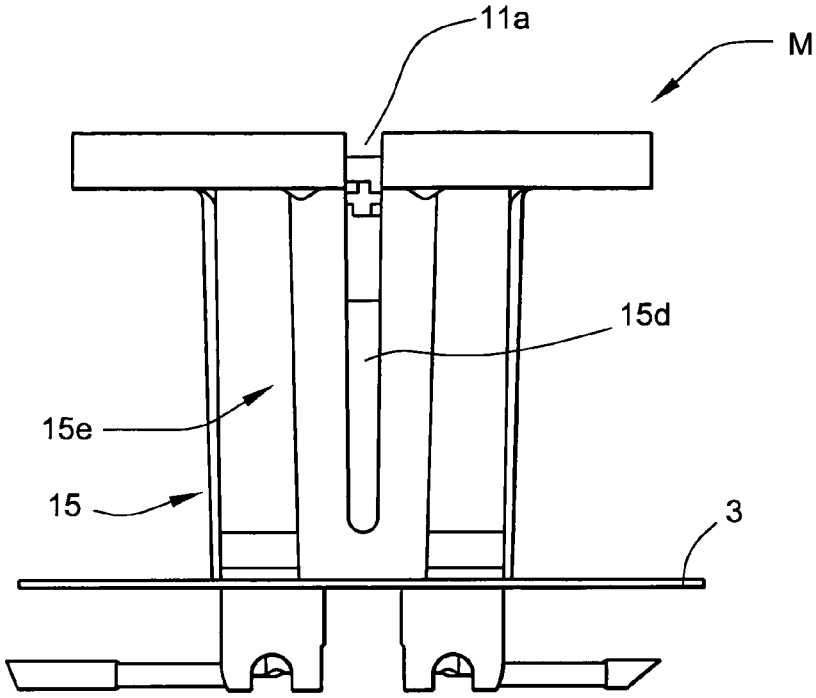
FIG. 2*a* shows a prior art antenna element arrangement.
Figure 2B:
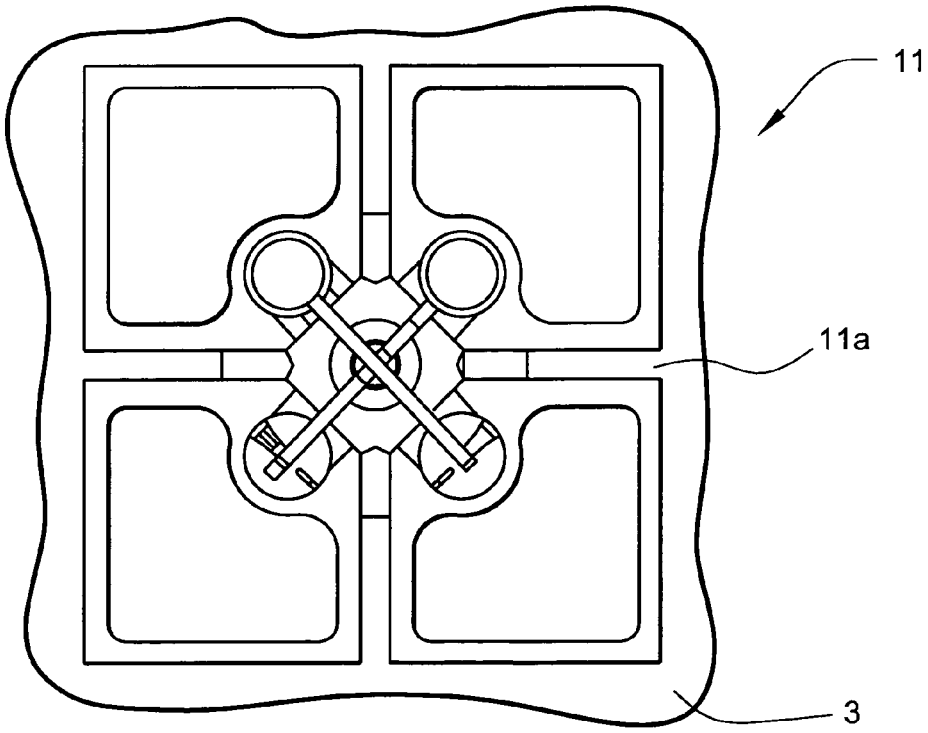
FIG. 2*b* shows a prior art antenna element arrangement.
Figure 3:
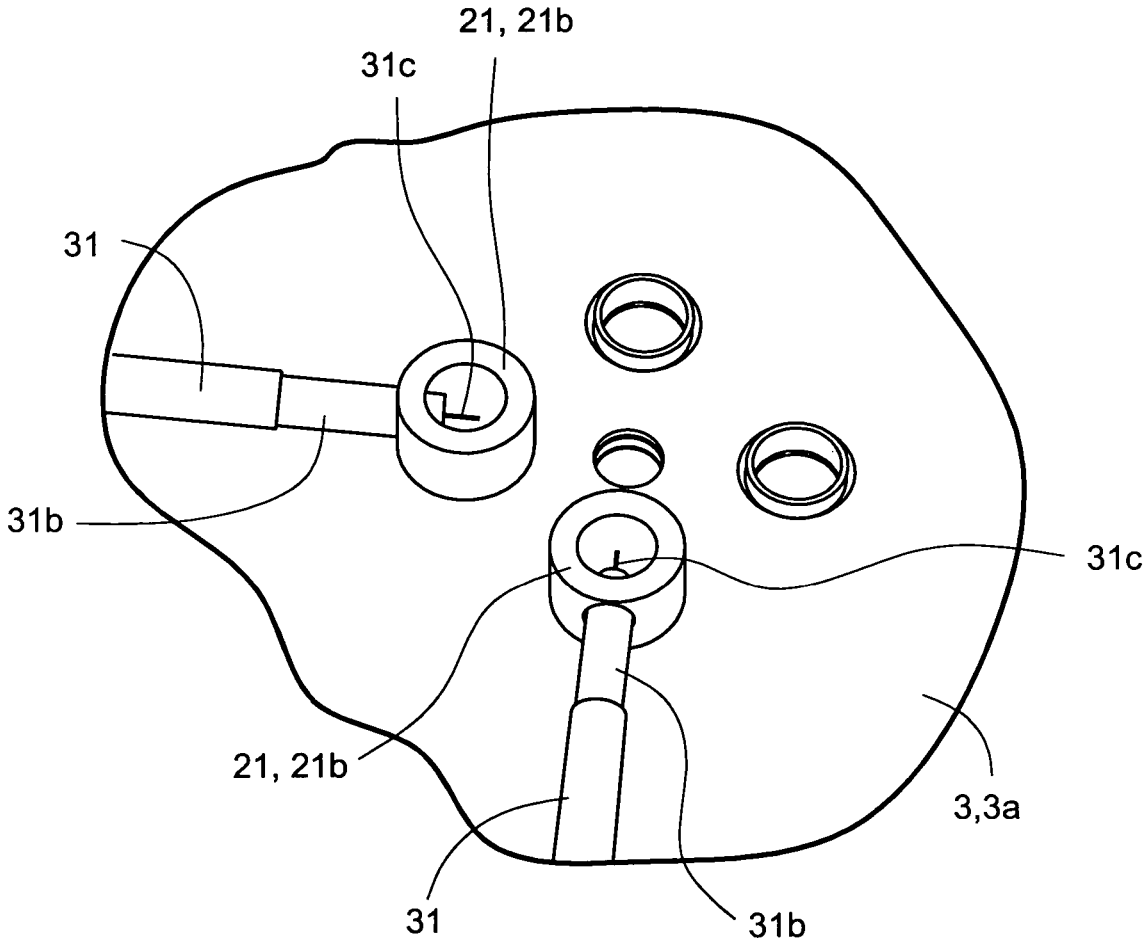
FIG. 3 shows a schematic view from the rear of the exemplary illustrative non-limiting reflector, to be precise of the point at which an antenna element as shown in FIG. 1 is mounted on the opposite side.

FIGS. 2 and 3 show different illustrations of a first antenna element arrangement 11 according to the exemplary illustrative non-limiting implementation on a reflector 3, in greater detail. In this case, in principle, the antenna element arrangement 11 has a configuration as is known from WO 00/39894, and as is described in detail there. Reference is therefore made to the entire disclosure content of the above publication, which is included in the content of this application. It is known from this for the antenna element arrangement 11 as shown in the form of a schematic plan view in the exemplary illustrative non-limiting implementations in FIGS. 1 to 3 to be precise in the form of a dipole square but, by virtue of the specific configuration, to transmit and receive as a cruciform dipole, from the electrical point of view. In this context, FIG. 1 shows the two polarization directions 12*a* and 12*b* for an antenna element arrangement 11, with these polarization directions 12*a* and 12*b* being at right angles to one another and being formed by the diagonal antenna element arrangement 11, which has a rather square shape in a plan view. The structures, which are in each case opposite through 180°, of the antenna element arrangement 11 to this extent act as dipole halves of two dipoles that are arranged in a cruciform shape.

An antenna element arrangement 11 which is in the form of a dipole and is formed in this way is held and mounted on the reflector 3 via an associated mount device or mount 15. The four dipole halves 13 in this exemplary illustrative non-limiting arrangement (which are arranged in a cruciform shape with respect to one another) and the associated mount device 15 are in this case composed of electrically conductive material, generally metal or a corresponding metal alloy. The dipole halves or the associated mount device or parts of it may, however, also be composed of a non-conductive material, for example plastic, in which case the corresponding parts are then coated with a conductive layer and/or may be coated with such a layer.

The perspective illustration in FIG. 2 also shows that the antenna element, which is cruciform from the electrical point of view, has a mount with an approximately square horizontal cross section, or has a square mount device 15 which is provided with slots 15*d* from top to bottom and which, in the illustrated exemplary illustrative non-limiting arrangement, end shortly in front of the reflector. These slots 15*d* are aligned with the slots 11*a* which in each case separate from one another two adjacent dipole halves of two polarizations which are at right angles to one another. The slots 15*d* in the mount device 15 thus in each case form the associated balancing 15*e* for the relevant dipole structure. The length of the slots and hence the length of the balancing that is formed by them may vary, with a value around $\gamma/4$ frequently being suitable for a relevant frequency.

In order now to ensure capacitive and/or inductive coupling on the reflector plate 3, that is to say to use a connection with no electrical contact, a coupling element 21 which is in the form of a rod is mounted on the reflector 3 (FIGS. 4 to 7), with the illustrated exemplary illustrative non-limiting arrangement producing an electrically conductive connection to the reflector 3. Both the reflector and the coupling element which is in the form of a rod may be composed of non-conductive material. In this case, the corresponding parts are coated with a conductive layer. In this case, it is desirable to ensure that the electrically conductive layer on the coupling element and the corresponding conductive layer on the reflector are electrically conductively connected. If the reflector is conductive overall, the corresponding conductive layer on the coupling element must be electrically conductively connected to the reflector in its entirety.

In the illustrated exemplary non-limiting arrangement, the coupling element 21 which is in the form of a rod is tubular or cylindrical and in this case is pushed on from the rear face 3*a* of the reflector through a hole 23 which is aligned with this coupling element 21 which is in the form of a rod, until a corresponding step 21*a* on the hollow-cylindrical coupling element 21 abuts against the rearward face of the reflector 3. In other words, the external circumference of the section 21*b* of the coupling element 21 underneath the step 21*a* is broader than the hole 23, so that the cylindrical coupling element 21 can be pushed into the hole 23 only until the step 21*a* which has been mentioned abuts at the rear against the reflector. In this position, the coupling element 21 is electrically conductively connected, preferably by means of soldering, to the reflector 3, which is preferably in the form of a reflector plate. A hollow-cylindrical isolator 25 is then plugged onto this coupling element 21 which is in the form of a rod, with the internal diameter and the internal cross section of the isolator 25 preferably being matched to the external cross section and the external shape of the coupling element 21 which is in the form of a rod. In other words, if the coupling element 21 is hollow-cylindrical, the isolator is also hollow-cylindrical and is seated on the coupling element 21 more or less virtually without any play, or with only a small amount of play.

In the illustrated exemplary non-limiting arrangement, the hollow-cylindrical isolator 25 is provided at the bottom, that is to say adjacent to the reflector 3, with a circumferential edge or flange 25*a*, via which the isolator 25 rests on the front face 3*b* of the reflector.

The antenna element structure with its mount device 15, in whose interior an axial hole 15*a* is incorporated, is then plugged onto the isolator 25, which has an axial internal recess. In this process, the internal diameter and the internal cross-sectional shape of the axial hole 15*a* are once again matched to the external dimension and to the horizontal cross-sectional shape of the isolator 25, so that the mount device can also be plugged at least approximately without any play or with only a small amount of play onto the isolator 25.

In this case, the axial hole 15*a* in the mount device is preferably pushed onto the isolator 25 until the lower end face 15*b* (on which the reflector 3 is based) of the mount device 15 now rests on the non-conductive rim or flange 25*a* that is associated with the isolator 25. It can thus be seen from this that there is no need for any soldering process for mounting the mount device on the reflector 3, for attachment and mounting of the antenna element arrangement 11.

The axial length relationships could also be such that, when the antenna element is being fitted, its mount device 15 is pushed onto the isolator 25 until the upper end face 25*b*, which faces away from the reflector 3, abuts against a corresponding upper stop 15*c*, which faces the reflector 3, of the antenna element arrangement or of the associated mount device, to be precise such that the lower end face 15*b* of the mount device 15 ends at at least a short distance in front of the reflector 3, where it cannot make contact with the reflector 3.

In the illustrated exemplary non-limiting arrangement, a centering or fixing cap 22 is also provided, which surrounds the mount device 15 of the antenna element device 11, is fitted on the reflector, and likewise holds the mount device in the desired fixing position. For this purpose, the cap 22 is provided with an appropriate internal holder as well as a contact section 22*a*, so that the fitted mount device 15, which is generally conductive, of the antenna element arrangement 11 cannot make an electrically conductive contact with the reflector 3. The cap 22 or the cap mount device 22 may then, for example, be provided with latching or centering zones, which pass through corresponding holes or stamped-out regions in the reflector and can thus easily be placed on and attached to the reflector in the manner of snap-action connection. A cap centering device 22 such as this is also particularly suitable when no isolator is used, so that this makes it possible to anchor the mount device 15 in front of the reflector 3, without making any electrically conductive contact with the coupling element 21 which is in the form of a rod.

However, in principle, the mount device 15 may also be designed such that its lower end face, which faces the reflector 3 and, perhaps, also adjacent to this and at a certain height projecting axially from this end face, is designed such that it will not slide or is provided with a non-sliding coating in order to avoid any electrically conductive contact with the reflector plate or reflector 3 here. In this case, it would also be possible to dispense with the fixing cap 3 that has been mentioned.

The described measures result in capacitive outer conductor coupling 29, with the two coupling parts which produce the capacitive outer conductor couplings 29 on the one hand comprising the coupling element 21, which is electrically conductively connected to the reflector, and on the other hand comprising the mount device 15 or that section of the mount device 15 which surrounds the axial hole 15' and the mount device, which can be seen from the exemplary illustrative non-limiting implementation and comes to rest parallel to the coupling element 21. In accordance with the exemplary illustrative non-limiting implementation as explained, this is a coaxial capacitive coupling in which the coupling element 21 which is in the form of a hollow rod is arranged internally, and on which the corresponding section of the mount device 15 comes to rest on the outside, and surrounding this coupling element 21 in the circumferential direction.

Merely for the sake of completeness, it should be noted that the coupling element 21 which is in the form of a rod and is electrically conductive or is provided with an electrically conductive surface could likewise be capacitively connected on the lower face to the reflector 3, although this is not very advantageous in the present case.

In order, possibly, to fix the antenna arrangement 1 (which can be fitted just by pushing it on) on the reflector it is possible, for example, to fit a projecting tab on the lower face of the mount device 15, with this tab latching into a corresponding recess in the reflector, and preferably passing through it. This allows a simple snap-action connection to be produced. For removal, the tab which engages behind the reflector need then only be bent away in order to once again lift the antenna arrangement off upwards from the coupling element 21 which is in the form of a rod.

In order to functionally connect the antenna element arrangement, all that is required in this case is, for example, to provide a coaxial cable 31 at the coaxial cable end 31*a* on the rear face of the reflector 3 in a corresponding manner, that is to say, for example, to electrically connect a correspondingly stripped section of the outer conductor 31*b*, for example by soldering, to the conductive coupling element 21. The coaxial cable 31 may in this case be laid parallel on the rear face of the reflector, and a radial opening or radial hole in that section of the coupling element which is in the form of a rod which projects beyond the rear face of the reflector downwards laid into this area of the step 21*a*, where it is electrically connected. A corresponding axially projecting section of the inner conductor 31*c* may then be soldered to a prepared inner conductor section 37 at the bottom which, in the illustrated exemplary illustrative non-limiting implementation, is in the form of a reverse L and is inserted in this way from above into a corresponding recess 21*a* in the coupling element 21, which is in the form of a rod, from its upper open end face coaxially with respect to the longitudinal axis of the coupling element 21. The upper end section 37*a* (which produces a connection to the opposite dipole half 13) of this inner conductor structure then comes to rest in a corresponding transversely running recess 39 in the dipole antenna element structure and may in this case be electrically conductively connected at its free end to a solder point. In the exemplary illustrative non-limiting implementation shown in FIG. 4, the solder point 38 is located on an upper projection 41*a* of an electrically conductive hollow cylinder 41, whose end face is closed, which is seated in a further axial hole 41*b* of the mount device 15, and is thus electrically conductively connected.

The length of the mount device and/or the length of the coupling element 21 which is in the form of a rod is approximately $\lambda/4\pm<30\%$, that is to say approximately $$\lambda/4*(1\pm<0.3)$$

where $\lambda$ is in each case a wavelength in the frequency band to be transmitted, preferably the centre of the respective frequency band to be transmitted.

Figure 4:
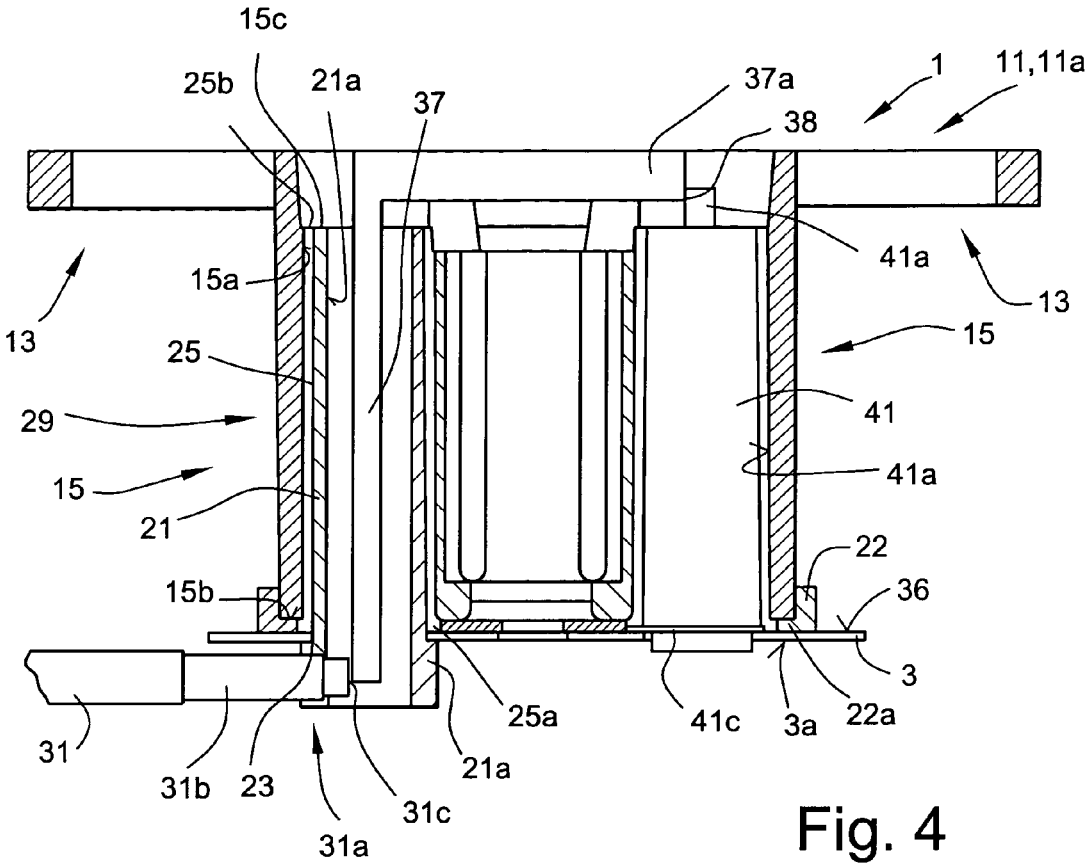
FIG. 4 shows a schematic axial cross-section illustration through an exemplary illustrative non-limiting antenna element as shown in FIG. 2.

As can be seen from the section illustration in FIG. 4, the cylinder 41 which is closed on the end face at the top and is electrically conductive overall, or at least has electrically conductive sections, is designed and arranged such that its circumferential surface and its upper end surface as well as the projecting pin 41*a* are not electrically conductively connected to the dipole structure or to the associated mount device 15. However, the lower face of the hollow cylinder 41 is preferably electrically conductively connected to the reflector plate via a circumferential collar 41*c*. Since the length of this hollow cylinder 41 is preferably around $\lambda/4\pm$ preferably less than 30% of this, this means that, in the end and located at the top, the inner conductor 31*c* of the coaxial feed cable is connected in the manner of a short circuit, located at the top, to the associated dipole half, that is to say in the area on the hollow cylinder 41 and, at the foot of the hollow cylinder, at which this is electrically connected to the reflector 3, is transformed to an open circuit. Conversely, the configuration likewise means that an open circuit at the upper end of the hollow cylinder is transformed to a short circuit at the foot of the hollow cylinder.

Figure 4A:
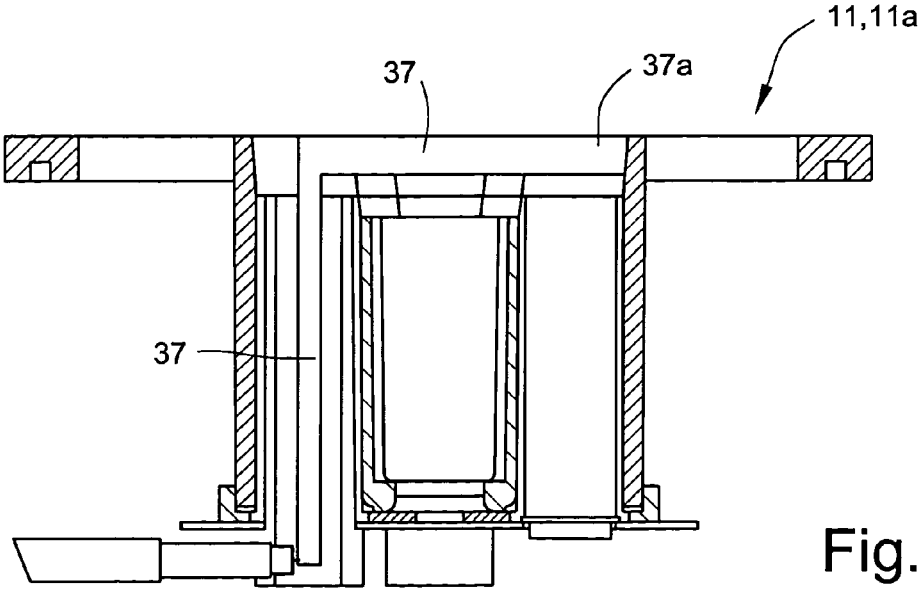
FIG. 4*a* shows a modified exemplary illustrative non-limiting arrangement with an electrically conductive inner conductor connection for one dipole half.

In contrast and according to the exemplary illustrative non-limiting implementation shown in FIG. 4, however, a direct electrically conductive connection for the associated dipole half could also be produced at the solder point 38 so that, in contrast to the dipole 4, the associated dipole half is connected directly and electrically conductively via the inner conductor section 37 to the inner conductor 31*c* of the coaxial feed cable, rather than being connected capacitively and/or inductively. This will be described with reference to FIG. 4*a* where, specifically, the end section 37*a* of the inner conductor section 37 is directly connected to the inner connecting end of an associated dipole half 11*a*, that is to say it is electrically conductively connected by means, for example, of a soldered joint. In order to achieve a high degree of symmetry, the mount 15 is, however, likewise provided underneath the end section 37*a* with an axial longitudinal hole in which, in this exemplary illustrative non-limiting implementation as well, the electrically conductive cylinder or hollow cylinder 41 is inserted, and makes electrically conductive contact with the reflector 3 at its foot point. Otherwise, this cylinder 41 does not make any electrical contact with the mount 15 by means of a metallic connecting link.

In the dual-polarized dipole structure as shown in FIGS. 1 and 3, the configuration (as has been explained with reference to the cross-section illustration shown in FIG. 4) is the same in a further section illustration which is offset through 90° and is at right angles to the reflector plane since, in a dual-polarized dipole structure, four axial holes are provided in the mount device, to be precise with two capacitive outer conductor couplings.

Figure 5:
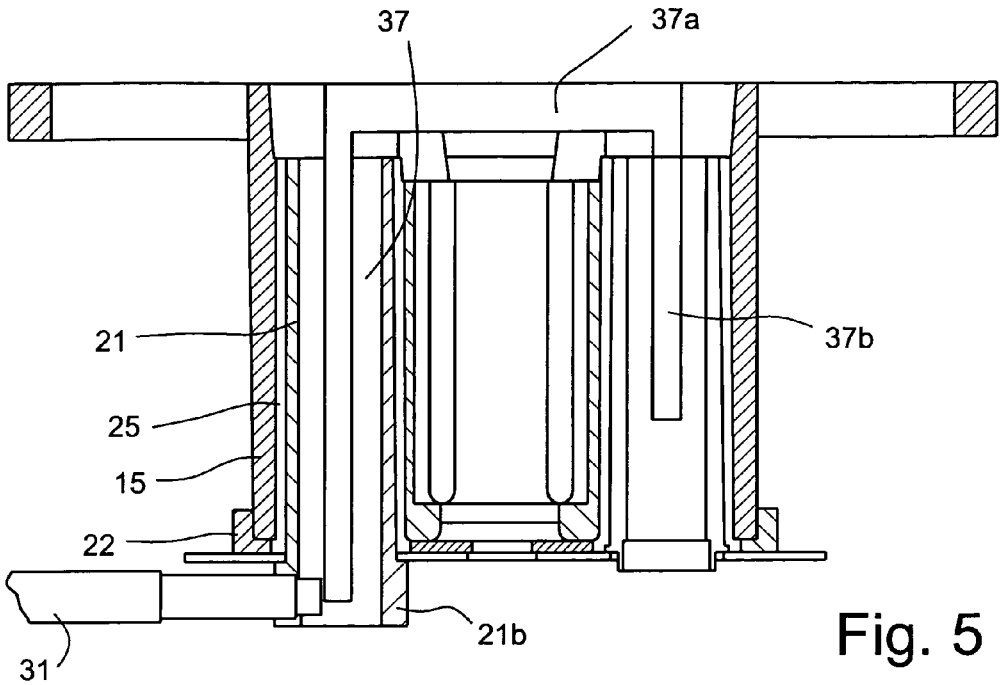
FIG. 5 shows a schematic axial cross-section illustration through an exemplary illustrative non-limiting antenna element as shown in FIG. 2.

FIG. 5 shows a modification in which capacitive inner conductor coupling is provided, in which an inner conductor section 37*b* enters the hollow cylinder 41*b*, which is open at the top, where it ends freely. Thus, in other words, the inner conductor section 37 is for this purpose provided with its line section, which is for example in the form of a rod and is passed through the hollow coupling element 21 and the upper, further line section 37*a*, which is adjacent to it and runs essentially parallel to the reflector plane, with a second inner conductor section 37*b*, a suitable length of which enters the axial hole 34*a* in the mount device 15. The hollow cylinder 41 is in this case likewise not electrically conductively connected to the electrically conductive mount device 15 but is merely seated with an electrically conductive link on the reflector 3, thus transforming an open circuit at the upper end of the hollow cylinder 41 to a virtual short circuit at the foot of the hollow cylinder 41 and, conversely, transforming a virtual short circuit at the upper end of the hollow cylinder to an open circuit at its foot in the area of the reflector 3.

Figure 6:
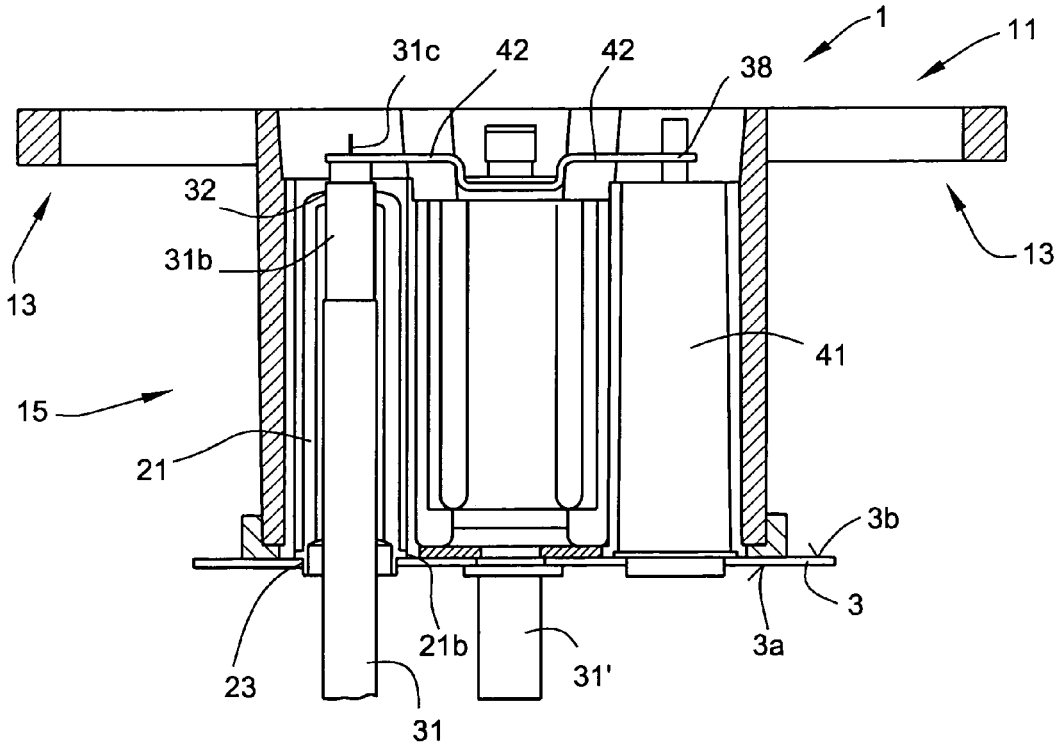
FIG. 6 shows a schematic axial cross-section illustration through an exemplary illustrative non-limiting antenna element as shown in FIG. 2.

In the exemplary illustrative non-limiting implementation shown in FIG. 6, and in contrast to FIG. 1, the coaxial feed cable 31 there is laid in the axial hole in the hollow coupling element 21 from the rearward face of the reflector 3 through the hole 21*a* which is formed there. In this case, a correspondingly stripped section at the end 31*a* of the coaxial cable is exposed, so that the outer conductor section 31*b* there is electrically conductively connected (for example at the contact point 32 (contact ring 32) and for example by means of soldering) to the upper end of the hollow-cylindrical coupling element 21, which is in the form of a rod, and is thus connected.

An inner conductor section 31*c* which projects upwards is then electrically connected via a cable clip 42 to the respectively opposite dipole half 13, to be precise for example at a solder point 38, which is comparable to that in FIG. 4, on a hollow cylinder arrangement 41 which is provided there and is closed at the end.

Figure 7:
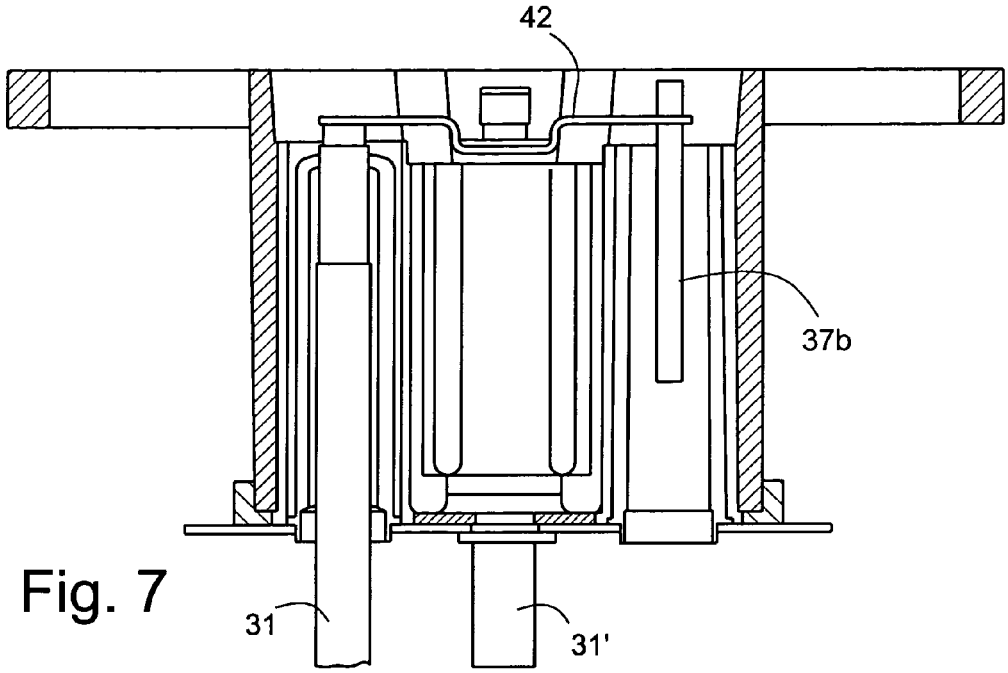
FIG. 7 shows a schematic axial cross-section illustration through an exemplary illustrative non-limiting antenna element as shown in FIG. 2.

FIG. 7 will be referred to only to show that the electrical connection capability described with reference to FIG. 6 for the outer conductor to the upper end of the coupling element 21 is also possible when the inner conductor is in turn capacitively coupled to the opposite dipole half. For this purpose, the clip 42 which has been mentioned is electrically connected to a corresponding inner conductor 37*b*, as has been explained in principle with reference to FIG. 5.

In addition to the coaxial feed cable 31, FIGS. 6 and 7 also show a further coaxial feed cable 31' which, in the exemplary illustrative non-limiting implementation illustrated in FIGS. 6 and 7, is used for feeding the two further dipole halves, which are at right angles to the first dipole halves. In other words, if the feed cable 31 is used for feeding the associated dipole halves which, for example, transmit in the polarization plane 12*a* as shown in FIG. 1, then the coaxial feed cable 31' is used for feeding the dipole halves which are offset through $_{90}$° and which transmit or receive using the polarization plane 12*b*.

Finally, FIGS. 6 and 7 will also be used to show that the stop 21*a* which has been mentioned with reference to FIGS. 4 and 5 for the coupling element 21, which is in the form of a rod, need not come to rest on the rearward face 3*a* of the reflector 3 in the mounted position, but that a stop 21*a* which is aligned in a corresponding reverse manner on the coupling element 21 may also be configured such that the coupling element 21*b* can be pushed from above into the hole 23 in the reflector 3 until the stop 21*b*, which projects radially in the circumferential direction, or parts of which project radially in the circumferential direction, abuts against the reflector upper face 3*b* of the reflector 3.

Figure 8:
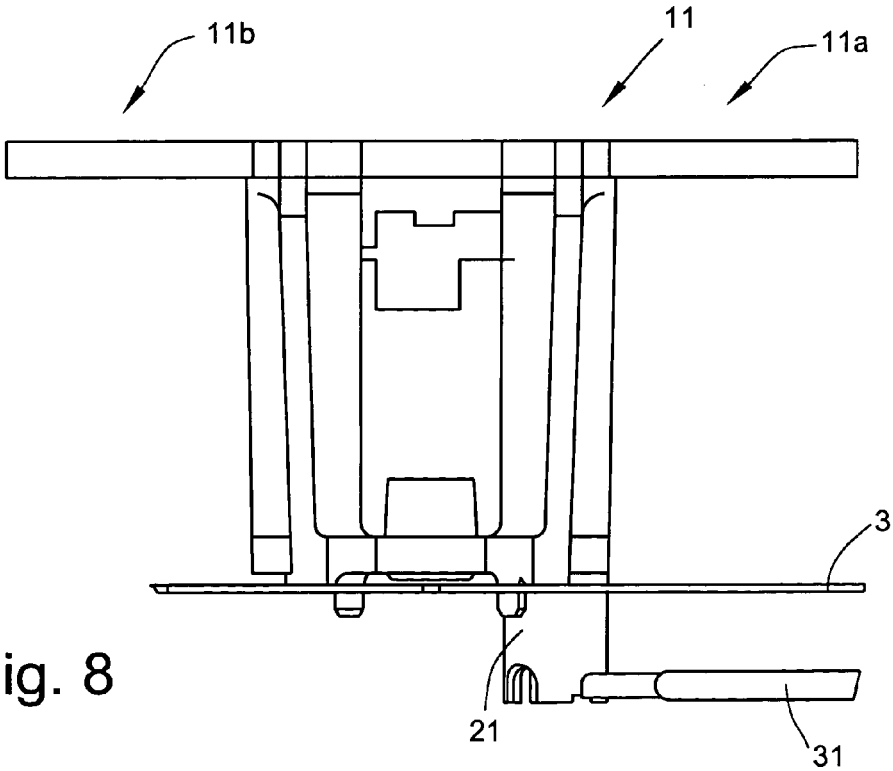
FIG. 8 shows a schematic side view of a modified exemplary non-limiting implementation of a dipole antenna element.
Figure 9:
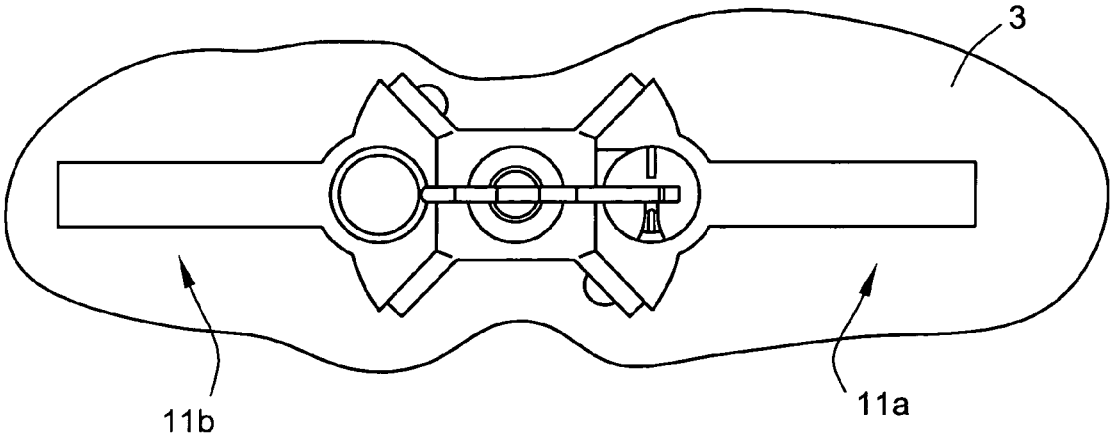
FIG. 9 shows a schematic plan view of an exemplary illustrative non-limiting dipole as shown in FIG. 8 but which radiates in only one polarization plane and which is connected according to exemplary illustrative non-limiting implementation by means of an outer conductor coupling which is, in particular, capacitive and/or inductive.

The following text refers to the schematic side view shown in FIG. 8 and to the plan view shown in FIG. 9, which illustrates an antenna element arrangement 11 which transmits in only one polarization plane and comprises a dipole 11 with two diametrically opposite dipole halves 11*a* and 11*b*.

FIGS. 8 and 9 will in this case be used only to indicate that the described coupling according to the exemplary illustrative non-limiting implementation, in particular a capacitive and/or possibly inductive coupling as well, is also possible with a single dipole antenna element.

Components with the same reference symbols as those in the previous exemplary illustrative non-limiting implementations to this extent denote at least functionally identical parts. To this extent, reference should be made to the previous exemplary illustrative non-limiting implementations.

Figure 10:
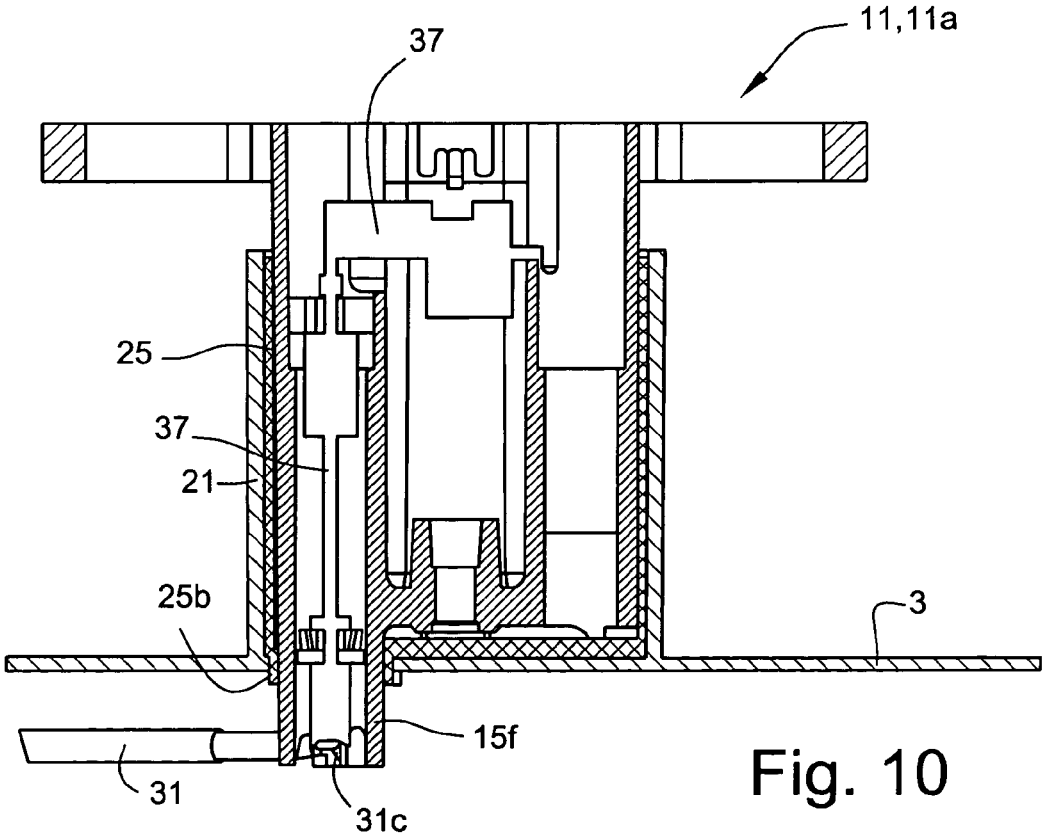
FIG. 10 shows an exemplary non-limiting arrangement which has been modified from that shown in FIGS. 4 and 5, in the sense of reversal of the coupling principle according to an exemplary illustrative non-limiting implementation, in which the coupling element is pot-shaped, and an antenna element device is positioned in the interior of the mount that has been inserted into it, producing an outer conductor coupling which is, in particular, capacitive and/or inductive.

Finally, the following text also refers to a further exemplary illustrative non-limiting implementation as shown in FIG. 10, which illustrates a modified exemplary illustrative non-limiting implementation.

In contrast to the exemplary illustrative non-limiting implementations explained initially, a capacitive coupling (and/or possibly an inductive coupling) is provided here, in particular a so-called capacitive and/or inductive outer conductor coupling in the sense of a reversal of the coupling principle, such that the coupling element 21 which is electrically conductively connected to the reflector 3 is now pot-shaped, and the electrically conductive mount device 15 of an antenna element arrangement 11 is now inserted into this pot-shaped coupling element 21. In this case, the mount device 15 is separated both from the coupling element 21 and from the electrically conductive reflector 3 by the use of an electrically conductive connection, for which purpose an isolator 25 is likewise preferably used. In the illustrated exemplary illustrative non-limiting implementation, this isolator 25 is also pot-shaped and is first of all inserted into the pot-shaped coupling element 21, with the isolator 15 having projecting at the bottom in its base area a tubular attachment 25*b*, which in the illustrated exemplary illustrative non-limiting implementation is a cylindrical attachment 25*b*, thus forming a tubular section, which is open at the bottom, and, in the illustrated exemplary illustrative non-limiting implementation, is cylindrical. The mount device 15 is also provided with an attachment 15*f* which projects downwards beyond the lower end face, is lengthened in a tubular shape, and is now additionally held centered by the tubular attachment 25*b* of the isolator 25, and is positioned such that it makes an electrically non-conductive (ground) contact with the reflector 3. The inner conductor of a coaxial feed line 31 can then be connected appropriately via the lower end opening of this attachment 15*f* on the mount device 15, in which case the corresponding dipole half of a dipole antenna element can be fed as in the described manner via an inner conductor intermediate connection 37. An inner conductor intermediate connection 37 is in this case once again held by means of an isolating spacer in the interior of the tubular mount device 15, via which the inner conductor of a coaxial cable can be electrically connected to the associated dipole half. The outer conductor 31*b* of a coaxial feed line must then once again preferably be electrically conductively connected to the pot-shaped coupling element 31 in some suitable manner, in which case a soldered joint may in this case be produced from the outer conductor 31*b* of the coaxial feed line 31 to the lower face of the reflector 3, preferably in the vicinity of the foot point, at which the pot-shaped coupling element 21 is electrically conductively connected to the reflector 3.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

The invention claimed is:

1. An antenna having a reflector and at least one dipole antenna element arrangement, the antenna comprising:

at least one dipole-like antenna element;

an electrically conductive mount device, at least indirectly mechanically connected to and/or mounted on the reflector, the mount device being capacitively connected to the reflector and/or being electrically conductively connected to the reflector without touching the reflector, a coupling element in the form of a rod, said coupling element being electrically conductive and extending transversely with respect to the reflector plane on the front face of the reflector, the mount device having an axial hole in the interior thereof, the axial hole in the mount device being positionable on the coupling element which is in the form of a rod, such that the mount device and the coupling element are capacitively coupled, while avoiding any electrically conductive contact.

2. The antenna according to claim 1, wherein the coupling element which is the form of a rod is cylindrical.

3. The antenna according to claim 1, wherein an isolator, which is provided with an axial recess and onto which the associated axial hole in the mount device is pushed, is placed onto the coupling element which is in the form of a rod.

4. The antenna according to claim 1, further including an isolator on the side facing the reflector, the isolator having an edge or flange which projects at least partially radially and on which the mount device rests.

5. The antenna according to claim 1, wherein the length of the hollow isolator is greater than the insertion depth with which the mount device of an antenna element arrangement can be placed on the coupling element, such that the stop which faces away from the reflector on the coupling element abuts against a stop, which faces the reflector, on the antenna element arrangement or the associated mount device, such that the mount device comes to rest at at least a short distance in front of the plane of the reflector in the mounted state.

6. The antenna according to claim 1, wherein a cap or a cap centering device is mounted on the reflector and accommodates, and holds, the mount device of an antenna element arrangement such that it is centered, without any electrical connection to the reflector.

7. The antenna according to claim 1, wherein an inner conductor of a coaxial cable is electrically conductively connected to the lower end of the coupling element, via an inner conductor section which passes through the coupling element which is provided with an axial recess.

8. The antenna according to claim 1, wherein an outer conductor of a coaxial cable is electrically conductively connected to the upper end of the coupling element which is provided with an axial recess.

9. The antenna according to claim 1, wherein an inner conductor of a coaxial cable is electrically conductively connected to the upper end of the coupling element by means of an electrical line connection, via which an electrical connection can be produced to the respective opposite dipole half.

10. The antenna device according to claim 1, wherein the antenna element arrangement has a dipole antenna element, for which only one coupling element is provided.

11. The antenna according to claim 1, wherein the antenna element arrangement comprises an antenna element arrangement which is cruciform at least from the electrical point of view, so that at least two coupling elements are provided, and are positioned in corresponding recesses in the mount device.

12. The antenna according to claim 1, wherein the configuration of the antenna element arrangement and the mount device is symmetrical, and a symmetrical configuration is provided for two dipole halves in each case, such that each of the two dipole halves is associated with a respective axial hole in the mount device, with the coupling element being arranged in one axial hole, and a further coupling element which is provided for inner conductor coupling being positioned in the respective other axial hole which is parallel to it.

13. The antenna according to claim 1, further comprising an outer line capacitively coupled between the coupling element and the mounting element.

14. The antenna according to claim 1 further comprising a fixing cap disposed on said reflector, said fixing cap having a contact section allowing the mounting element to be anchored in front of the reflector without making electrical conductive contact with the coupling element.

15. The antenna according to claim 1, wherein the coupling element which is the form of a rod has a recess which runs axially in the interior thereof.

16. The antenna according to claim 15, wherein the coupling element which is the form of a rod is hollow-cylindrical.

17. The antenna according to claim 1, further providing a capacitive outer conductor coupling in the form of air as a dielectric.

18. The antenna according to claim 17, wherein the antenna element arrangement and the associated mount device are fixed by means of an isolator placed on the reflector, above which that area or section which can be placed on the isolator and faces the reflector, the end face of the mount device is positionable in front of the reflector such that it engages over the coupling element which is in the form of a rod, in a relative position in which no contact is made.

19. The antenna according to claim 1, wherein a hole is incorporated in the reflector such that it is axially aligned with the coupling element which is the form of a rod, through which hole part of the length of the coupling element which is in the form of a rod passes through the reflector.

20. The antenna according to claim 19, wherein a radially projecting projection or a circumferential step is formed on the coupling element, so that part of the length of the coupling element which is in the form of a rod can be inserted through the hole in the reflector until it reaches a stop or a step on the reflector.

21. The antenna according to claim 20, wherein the coupling element can be inserted into the hole from the rearward face of the reflector or from the front face of the reflector, so that the radially projecting stop or step comes to rest on the rear face or on the front face, respectively, of the reflector.

22. The antenna according to claim 1, wherein an outer conductor connection is made such that the outer conductor of a coaxial cable is electrically conductively connected to the lower end of the coupling element which is provided with an axial recess.

23. The antenna according to claim 22, wherein the outer conductor of a coaxial cable is electrically conductively connected on the rear face of the reflector to that section of the coupling element which projects as far as the rear face of the reflector.

24. The antenna according to claim 22, wherein the inner conductor is electrically conductively connected to the respective opposite dipole half.

25. The antenna according to claim 22, wherein the inner conductor of a coaxial cable is at least indirectly capacitively connected to the opposite dipole half.

* * * * *